US009003580B2

(12) United States Patent
Ross

(10) Patent No.: US 9,003,580 B2
(45) Date of Patent: Apr. 14, 2015

(54) MATTRESS DISPLAY

(71) Applicant: Dreamwell, Ltd., Las Vegas, NV (US)

(72) Inventor: James P. Ross, Atlanta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 13/908,326

(22) Filed: Jun. 3, 2013

(65) Prior Publication Data

US 2013/0318715 A1 Dec. 5, 2013

Related U.S. Application Data

(60) Provisional application No. 61/642,511, filed on Jun. 4, 2012.

(51) Int. Cl.

| | |
|---|---|
| ***A47G 5/00*** | (2006.01) |
| ***A47C 21/00*** | (2006.01) |
| ***A47F 7/30*** | (2006.01) |

(52) U.S. Cl.

CPC .. *A47C 21/00* (2013.01); *A47F 7/30* (2013.01)

(58) Field of Classification Search

CPC ..... A47C 21/00; A47C 19/20; A47C 19/00; A47C 19/005; A47C 19/021; A47C 19/022; A47C 19/04; A47C 19/22; A47F 7/30; A47H 1/022; F16B 12/60; G09F 1/12

USPC ..... 5/2.1, 8, 9.1, 512

See application file for complete search history.

(56) References Cited

U.S. PATENT DOCUMENTS

| | | | | | |
|---|---|---|---|---|---|
| 2,528,871 | A | * | 11/1950 | Deuschle | 5/183 |
| 2,569,574 | A | * | 10/1951 | Parker | 5/8 |
| 2,796,614 | A | * | 6/1957 | Villa Torre | 5/8 |
| 2,909,789 | A | * | 10/1959 | Bailey | 5/8 |
| D246,018 | S | * | 10/1977 | Hero et al. | D6/384 |
| 8,316,479 | B2 | * | 11/2012 | Colombo | 5/8 |
| 2012/0299741 | A1 | | 11/2012 | Wright, Jr. | |

* cited by examiner

*Primary Examiner* — Robert G Santos
*Assistant Examiner* — Richard G Davis
(74) *Attorney, Agent, or Firm* — Cantor Colburn LLP

(57) ABSTRACT

A mattress display includes at least one primary test bed including a head portion and a foot portion; at least one secondary test bed including a head portion and a foot portion; a wall, wherein the at least one primary and secondary test beds are in a spaced apart parallel relationship and positioned perpendicular with respect to the wall, wherein the at least one primary test bed is oriented such that the head portion is distally located from the wall and the foot portion 20 is proximal to the wall, and wherein the at least one secondary test bed is oriented such the head portion is proximal to the wall and the foot portion is distal to the wall; and a barrier disposed in close proximity to the head portion of the primary test bed, wherein the barrier is configured to provide an end user of the primary test bed with at least partial privacy, noise reduction, and/or light reduction.

11 Claims, 2 Drawing Sheets

MATTRESS DISPLAY

CROSS REFERENCE TO RELATED APPLICATIONS

This non-provisional application claims the benefit of U.S. Provisional Patent Application Ser. No. 61/642,511 filed on Jun. 4, 2012, which is fully incorporated herein by reference in its entirety.

BACKGROUND

Mattresses are displayed in showrooms during the sale and distribution from the mattress manufacturer to the consumer. First of all, mattress manufacturers may display mattresses in wholesale showrooms so that retailers can get an idea of how the mattress will look in their own retail showrooms. In retail showrooms, display mattresses are arranged on the retail floor so that the prospective purchaser can peruse the various types of mattresses offered by that retailer. In each situation, marketing and/or technical features of the mattresses are communicated to the prospective purchaser via signage, labels or a personal communication between the sales representative and the prospective purchaser. A prospective purchaser intending to purchase a new mattress may be intimidated by the process of testing a mattress in a public retail showroom.

Accordingly, there is a need for a system that allows a consumer to be able to easily discern and view the technology used in a mattress.

BRIEF SUMMARY

Disclosed herein are mattress showroom displays for displaying a mattress assembly in a retail environment.

In one embodiment, the mattress display comprises at least one primary test bed including a head portion and a foot portion; at least one secondary test bed including a head portion and a foot portion; a wall, wherein the at least one primary and secondary test beds are in a spaced apart parallel relationship and positioned perpendicular with respect to the wall, wherein the at least one primary test bed is oriented such that the head portion is distally located from the wall and the foot portion 20 is proximal to the wall, and wherein the at least one secondary test bed is oriented such the head portion is proximal to the wall and the foot portion is distal to the wall; and a barrier disposed in close proximity to the head portion of the primary test bed, wherein the barrier is configured to provide an end user of the primary test bed with at least partial privacy, noise reduction, and/or light reduction.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
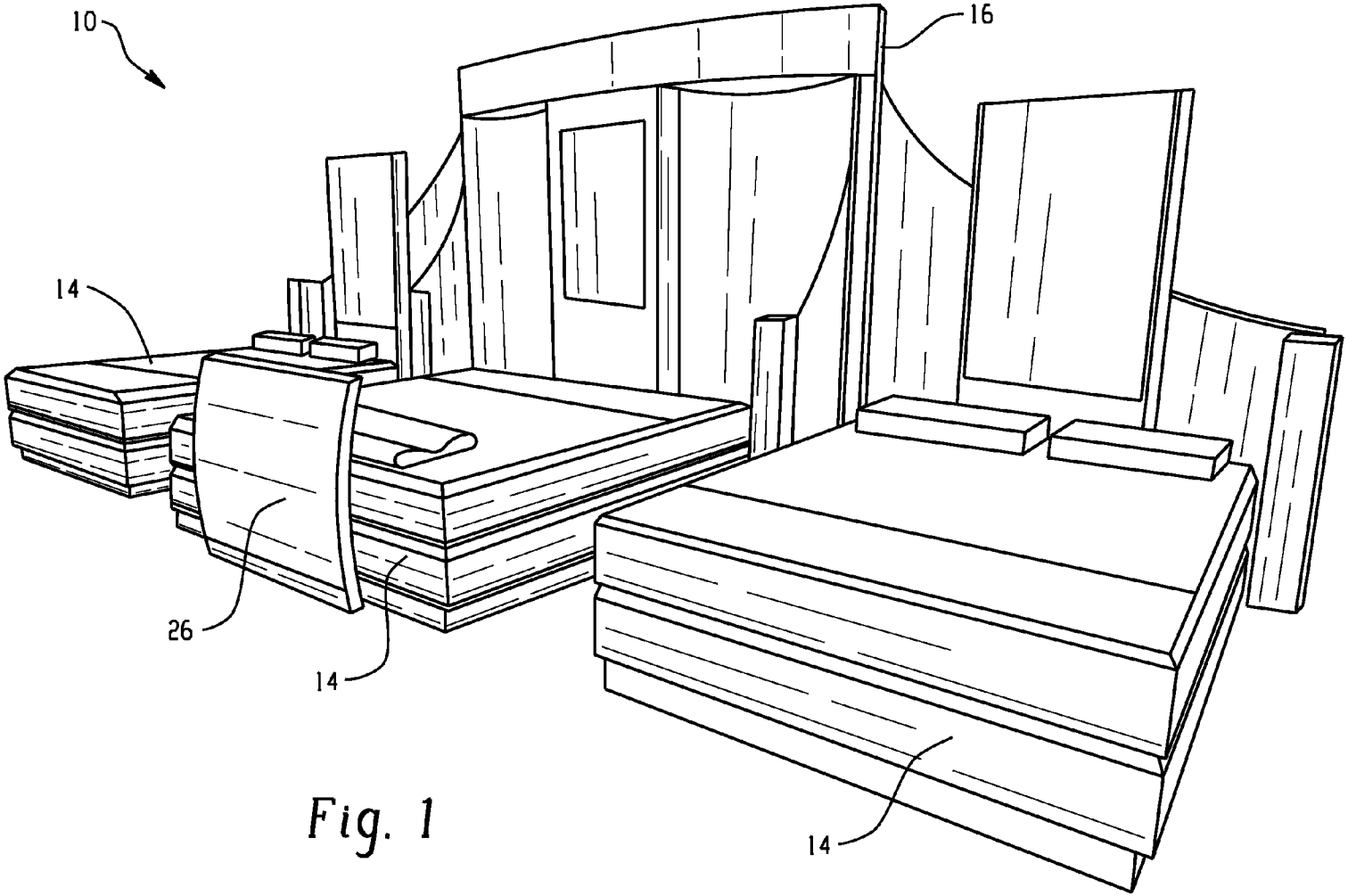
FIG. 1 illustrates a perspective view of the mattress showroom display including a primary test bed and two secondary test beds.
Figure 2:
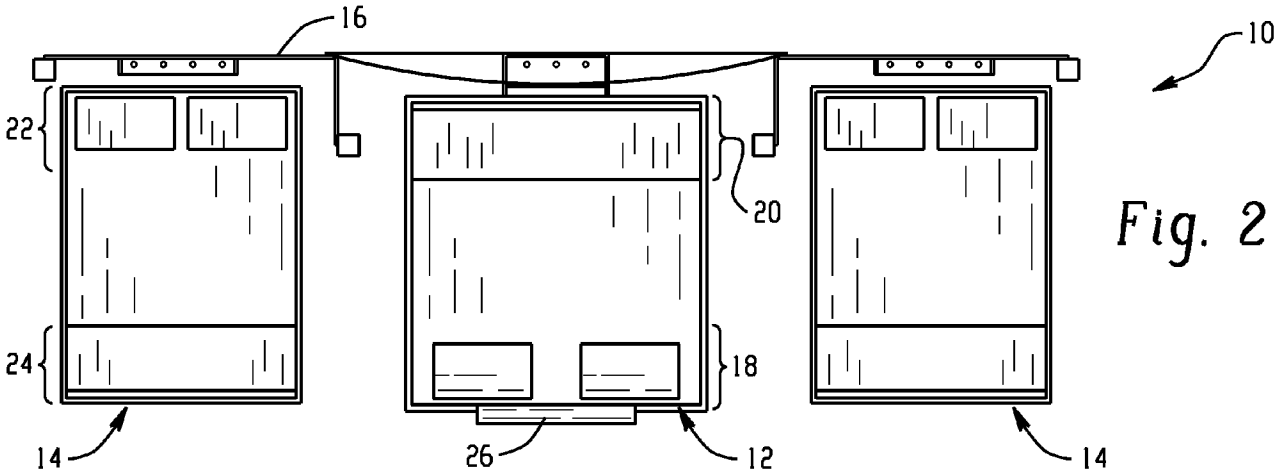
FIG. 2 illustrates a top down view of the mattress showroom display of FIG. 1.
Figure 3:
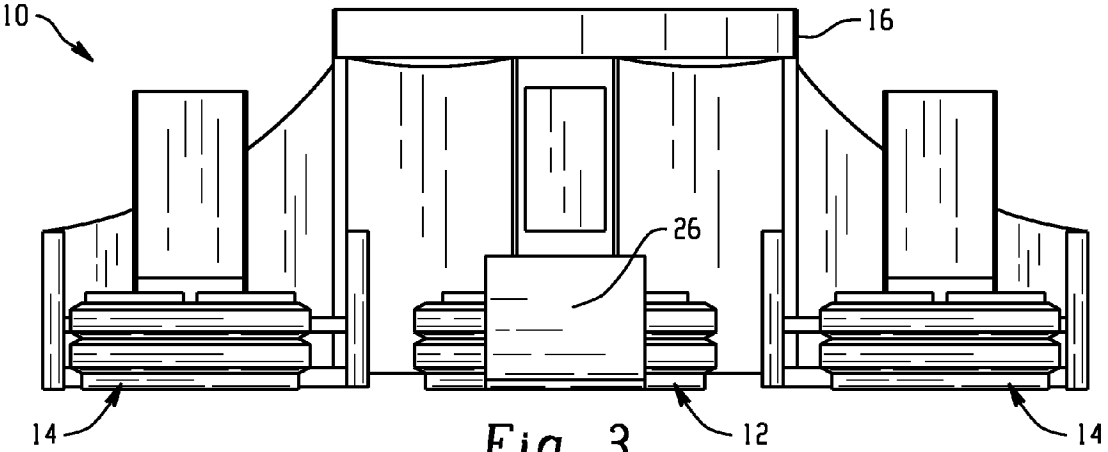
FIG. 3 illustrates an end on view of the mattress showroom display of FIG. 1.
Figure 4:
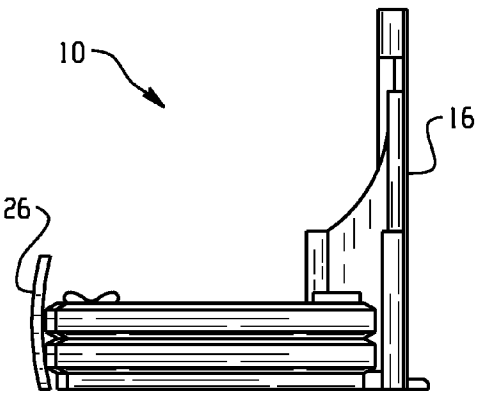
FIG. 4 illustrates a side view of the mattress showroom display of FIG. 1.

FIGS. 1-4 illustrate a mattress display 10 that generally comprises at least one primary test bed 12, a plurality of secondary test beds 14, and a wall 16, wherein the test beds 12, 14 are positioned perpendicular with respect to the wall 16. The illustrated mattress display 10 includes three beds, wherein the centrally located bed is the primary test bed 12 and the two adjacent beds are the secondary beds 14. However, it should be apparent that the mattress display 10 is not intended to be limited to three beds; more or less beds can be employed provided there is at least one primary test bed and at least one secondary test bed as described in greater detail below. The various test beds include a mattress and foundation. Optionally, the various test beds may include a pillow, sheeting, foot protectors, and like ancillaries.

The primary test bed 12 is perpendicularly positioned to the wall 16 such that the head portion 18 is distally located from the wall and the foot portion 20 is proximal to the wall. The head portion is generally defined as the portion wherein an end user rests its head when prone on the test bed and can be readily determined by the presence of pillows and/or an envelope opening of the bed sheet, comforter or the like disposed on the bed. The foot portion is generally defined as the portion wherein an end user rests its feet when prone on the test bed. A foot protector may be disposed on the test beds at the foot portion to protect the underlying mattress during use as a display.

The secondary beds 14 are disposed in a spaced apart parallel relationship to the primary test bed 12 and are positioned such that the head portions 22 are proximal to the wall 16 and the foot portion 24 is distal to the wall 16.

The mattress showroom display further includes a barrier 26 disposed in close proximity to the head portion 18 of the primary bed 12. In one embodiment, the barrier 26 is centrally positioned relative to the head portion 18.

In one embodiment, the barrier 26 is configured to provide at least partial privacy, noise reduction, light reduction, and/or the like to the end user of the primary test bed 12 from the external environment, which is often a store, convention center, manufacturer test center, and the like, where there are typically potential customers, sales representatives, and the like moving about. In one embodiment, the barrier 26 includes a curvilinear shape. However, it should be apparent that any shape is suitable so long as it is configured to provide at least partial privacy to an end user resting its head at the head portion 18 of the primary test bed 12. As used herein, the term "at least partial privacy" is intended to mean that an end user resting its head at the head portion 18 has its head at least partially shielded from the environment, e.g., foot traffic, lighting, noise, and the like, directly in front of the primary test bed 12.

In the illustrated embodiment, the barrier 26 includes a base portion that is seated on a supporting surface and further includes an elongated section extending from the base portion and terminating at a height above the planar top surface of a mattress. In one embodiment, the elongated section extending from the base portion terminates at a height of about 36 inches or less above the planar top surface of a mattress. In other embodiments, the elongated section extending from the base portion terminates at a height of about 24 inches or less above the planar top surface of a mattress. In still other embodiments, the elongated section extending from the base portion and terminating at a height of about 12 inches or less above the planar top surface of a mattress. The width of the barrier 26 is not intended to be limited and will generally depend on the intended use. In one embodiment, the width is greater than the approximate diameter of an end user's head, e.g., greater than about 6 inches. In other embodiments, the barrier width is greater than about 12 inches and in still other embodiments, the barrier width is greater than 24 inches. In most applications, the barrier width will be less than or equal to a width of the test bed, which can vary depending on the bed size, e.g., full, queen, king, and the like. In some applications, the barrier width may be greater than the width of the test bed. The supporting surface may include the floor of the showroom or may be the mattress assembly itself. For example, the barrier 26 may be affixed to the mattress foundation.

In the embodiment shown, the barrier 26 has a curvilinear shape, wherein the curve is generally oriented towards the end user of the primary test bed 12. However, the shape and barrier dimensions are not intended to be limited to any particular shape and/or dimensions. Likewise, the barrier 26 can be of unitary construction or multi-piece construction. The barrier 26 advantageously provides privacy and sound protection to an end user lying prone on the primary test bed 12 from pedestrian traffic as well as the environmental conditions in which the mattress display is employed, e.g., light, sound, and the like. This barrier 26 can also be used to project lighting, images, video and/or project sound towards the end user and/or to the pedestrians passing by the mattress display. As shown, the barrier 26 includes indicia of the BEAUTY-REST trademark.

As previously discussed, the wall 16 can be removable as well as part of a permanent fixture, e.g., a building wall. In the embodiment shown, the length of the wall 16 is effective to accommodate the number of beds, i.e., primary and secondary test beds, so that each bed perpendicularly extends from the wall. In other embodiments, the length of the wall is about the width of the primary test bed. The wall 16, like the barrier 26, can be used to incorporate any form of media including but not limited to stationary pictures, video, sound, and the like. Similarly, the wall and /or barrier can be configured to provide ambient lighting.

By way of example, the wall 16 and/or the barrier 26 can display selectively changeable product information to a customer considering a mattress. As mattress products in the showroom change, or marketing programs change, product information may be developed and displayed via a media display device integrated into the wall and/or barrier, on a corresponding mattress foot protector, and/or pillows, respectively. In other embodiments, more than one media display device may be associated with the wall and/or barrier and/or the test beds and ancillaries thereof.

The media display device can be in electronic communication with a programmable product information source to present selectively changeable product information to the customer. The programmable product information source can present differing information over the same display device. For example, the display device can be programmed to show and/or describe one type of information, then moved to a different mattress and be reprogrammed to properly show and/or describe that mattress. The programmable product information source can also change the information periodically to present differing text or media about the same mattress to the customer as he/she is inspecting or approaching the mattress. Although not shown in the figures, the media display device can also play audio signals coordinated with displayed product information, via an audio source. The audio source may be played through speakers in the media display or a separate receiver in the showroom or coupled to the wall and/or barrier. In other embodiments, a sensor (not shown) in the mattress display activates the media display when a person approaches the mattress to attract his/her attention.

The mattress display 10 may be used with any type of mattress and mattress and/or bedding component. For example, twin, twin XL, full, queen, king, the "California king," are exemplary sized mattresses, and associated headboards.

Advantageously, the mattress display provides the end user of the primary test bed with a level of privacy not previously available in manufacturer and/or retail showrooms.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress display comprising:

at least one primary test bed including a head portion and a foot portion;

at least one secondary test bed including a head portion and a foot portion;

a wall, wherein the at least one primary and secondary test beds are in a spaced apart parallel relationship and positioned perpendicular with respect to the wall, wherein the at least one primary test bed is oriented such that the head portion is distally located from the wall and the foot portion is proximal to the wall, and wherein the at least one secondary test bed is oriented such the head portion is proximal to the wall and the foot portion is distal to the wall; and a stand-alone barrier spaced apart from the wall and disposed in close proximity to and directly behind the head portion of the primary test bed, wherein the barrier is configured to provide an end user of the primary test bed with at least partial privacy, noise reduction, and/or light reduction.

2. The mattress display of claim 1, wherein the barrier comprises a base portion extending from a supporting surface and an elongate portion terminating at a height above a planar surface of a mattress; and has a width greater than or equal to 6 inches.

3. The mattress display of claim 1, wherein the barrier is affixed to the bed.

4. The mattress display of claim 1, wherein the barrier comprises a curvilinear shape having a concave side positioned towards the head portion of the primary test bed.

5. The mattress display of claim 1, wherein the barrier and/or the wall comprise a media display, a tactile display, lighting, indicia, audio, and combinations thereof.

6. The mattress display of claim 1, wherein the wall is configured to span a width of the at least one primary and the at least secondary test bed.

7. The mattress display of claim 1, wherein the test bed comprises a mattress and foundation.

8. The mattress display of claim 7, further comprising one or more pillows individually disposed at the head portions of the at least one primary test bed and the at least one secondary test bed.

9. The mattress display of claim 1, wherein the barrier comprises a base portion extending from a supporting surface and an elongate portion terminating at a height less than 36 inches from a planar surface of a mattress.

10. The mattress display of claim 1, wherein the mattress display comprises two secondary test beds and one primary test bed intermediate and in a spaced apart parallel relationship relative to the two secondary test beds.

11. The mattress display of claim 1, wherein the wall is removable.

* * * * *